US006997573B2

(12) United States Patent
Maese

(10) Patent No.: US 6,997,573 B2
(45) Date of Patent: Feb. 14, 2006

(54) LUMINESCENT INDICATOR VEST FOR USE WITH A MOTOR VEHICLE

(76) Inventor: Claudio Ivan Maese, 4609 Esparea, La., El Paso, TX (US) 79934

( * ) Notice: Subject to any disclaimer, the term of this patent is extended or adjusted under 35 U.S.C. 154(b) by 296 days.

(21) Appl. No.: 10/386,791

(22) Filed: Mar. 12, 2003

(65) Prior Publication Data

US 2004/0177428 A1 Sep. 16, 2004

(51) Int. Cl.
*F21K 2/08* (2006.01)
*B60Q 1/26* (2006.01)

(52) U.S. Cl. ..... 362/84; 362/108; 362/802; 340/465; 340/471

(58) Field of Classification Search ..... 362/84, 362/103, 108, 189, 473, 802, 812, 806, 105; 340/432, 463–468, 471, 475
See application file for complete search history.

(56) References Cited

U.S. PATENT DOCUMENTS

| | | | | |
|---|---|---|---|---|
| D259,146 | S | 5/1981 | Carr | |
| 4,328,533 | A | 5/1982 | Paredes | |
| 5,424,922 | A | 6/1995 | Wise | |
| 5,690,411 | A | 11/1997 | Jackman | |
| 6,538,567 | B1 * | 3/2003 | Stewart | 340/475 |
| 6,769,138 | B1 * | 8/2004 | Golle et al. | 2/102 |
| 2003/0213045 | A1 * | 11/2003 | Fuentes | 2/69 |

* cited by examiner

*Primary Examiner*—Sandra O'Shea
*Assistant Examiner*—Guiyoung Lee
(74) *Attorney, Agent, or Firm*—John K. Buche

(57) ABSTRACT

A safety vest adapted to be worn by riders of exposed motor vehicles, such as motorcycles, which vest is designed to be worn over clothing and has luminescent signaling means interconnected with the signaling apparatus of the motor vehicle so that the rider's actions and intentions of braking, turning, changing lanes or hazard are visually communicated to other motorists, thereby enhancing rider visibility and safety.

11 Claims, 3 Drawing Sheets

LUMINESCENT INDICATOR VEST FOR USE WITH A MOTOR VEHICLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present invention relates to the field of safety devices for use with operation of motor vehicles, namely, vests containing luminescent signaling means interconnected with the power and signaling apparatus of the motor vehicles.

2. Description of Prior Art

In the present world of heavy traffic, increasing populations, and diverse modes of transportation, it is particularly important that users of more exposed vehicles, for instance, motorcycles or bicycles be fully visible to larger vehicles whose field of vision of these exposed travelers may be hindered by discrepancies in size or other factors such as heavy traffic and noise. For riders of motorcycles, which travel at least as fast as other vehicles and on the same roadways, it is also important to be able to immediately communicate rider intentions to other motorists by visual means or signals. Without proper communication between motorcycle riders and other motorists, the motorcycle riders face an unnecessary and increased risk of serious injury or death by collisions with other motorists. Motorcycles have long been outfitted with blinkers, headlights and taillights similar to those commonly found on an automobile, however, the prior art makes no provision for a wearable, adjustable device with luminescent indicators which is interconnected with the power and signaling apparatus of the motor vehicle. The concept of a safety vest is not new. James M. Harrison U.S. Pat. No. 4,425,667 (1984) discloses a vest with special protectable plates for use by motorcycle riders. Joan A. P. Roe U.S. Pat. No. 4,598,661 (1986) discloses a water skiing vest with a flag that indicates when a skier is down. Ernest Q Paredes U.S. Pat. No. 4,328,533 (1982) discloses a vest for use by a pedestrian with blinking light bulbs on the shoulders to enhance visibility and reflective patches. Vernon L. Jackman U.S. Pat. No. 5,690,411 (1997) even discloses a vest that is capable of communicating signals such as left, right, stop and go by light signaling means. However, there is no provision in the prior art for a safety vest with luminescent signaling means that is interconnected with and feeds from a vehicle's existing power source and operates from the vehicle's existing signaling apparatus. There is nothing in the prior art, which discloses use of an adjustable vest coupled to a vehicle's power source and signaling source and which is used to activate a wearable light signal. Further, there is nothing in the prior art that discloses a vest adapted for use by multiple riders so that the vests of the riders may be interconnected and capable of communicating visual signals of rider intentions.

SUMMARY OF THE INVENTION

Accordingly, the objectives of the present invention are to provide an improved vehicle safety vest that enjoys the following attributes:

Better visibility than previous safety vests;

Interconnection between the light signal on the vest and a vehicle's existing power source and signaling apparatus;

Automatic break away functionality so that in an event of accidental dismount, the rider is not unwittingly latched to the vehicle.

Interconnection between vests of multiple riders so that all riders on the same vehicle benefit from the visual signals and feed from the same original signaling and power source;

Use of a luminescent signaling device available in multiple colors;

Ergonomic vest design that is user friendly, adjustable to fit over existing clothing, jackets and backpacks, stylish, nonbulky and wherein the light signal is preferably closely embedded on the surface of the vest so as to be readily visible to nonriders;

Vest design wherein light source on the vest may be readily replaced and substituted with alternate colors or replacement light sources;

Preferably adapted with pockets for personal use devices such as mp3, CD players, cell phones, PDA or wallets with a hole permitting a cable to run through the vest to the rider's ear.

To achieve such improvements, the present invention employs a connecting means that links the signal and light source on the vest to the power and signaling sources of a vehicle. Preferably, the vehicle is a motorcycle. In this manner, when the rider operates the standard signaling devices on the vehicle, namely the brakes, hazards, blinkers and headlights, a corresponding electronic signal is communicated to the light source in the rider's vest so that the vest lights up according to the action intended. For instance, activating the left blinker results in blinking action of the light source on the left side of the vest. Activating the right blinker results in activating a blinking light on the right side of the vest.

Activating the brake will cause all the lights on the vest to simultaneously illuminate brighter than a base level illumination. The light source on the vest is preferably always illuminated and visible during use, however, use of the brakes or blinker signals will cause an enhanced illumination and convey the rider's intentions that might not otherwise be apparent to other motorists. The electrical connection between the (1) vehicle signaling device and power source and (2) the vest passes through the vehicle fuse box and an adapter, which is preferably used so that the fuse box of any vehicle is readily and easily connectable to the vest by and through a vest port. The light source on the vest is preferably closely lined to the outer surface of the vest for maximum visibility.

BRIEF DESCRIPTION OF THE DRAWING

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
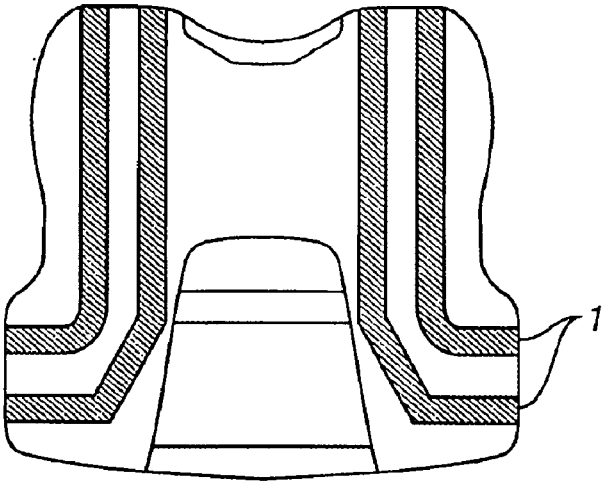
FIG. 1 is a frontal view of the vest which depicts the luminescent signaling means seen on the vest surface; a user friendly pouch for personal use devices, and a port where the vest meets with the power and signaling connection on the motorcycle.
Figure 2:
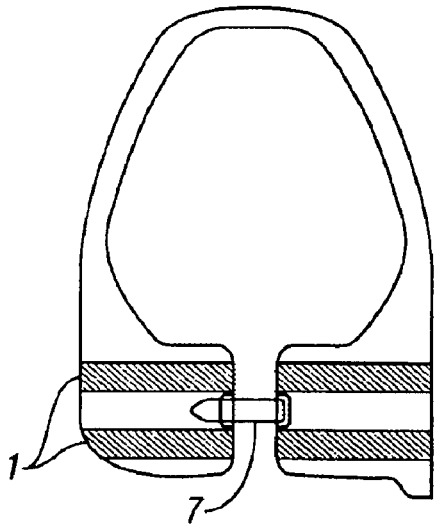
FIG. 2 is a back view of the vest showing the luminescent signaling means on the vest surface.

FIG. 1 is a front view of the preferred embodiment of a safety vest with signaling means 1 attached to the vest surface 2. The signaling means 1 give off light signals that may be seen by other motorists and that are electrically connected to the signaling apparatus and electrical power source of the rider's vehicle. The signaling means 1 are preferably made of a phosphorous-coated copper wire that becomes luminescent upon receipt of an electrical current, and which such wire is commercially available. In addition to the electroluminescent phosphorous-coated wire, it is also contemplated that the signaling means 1 could be made of fiber optic material or other material capable of both sustained luminescence and variance of light intensity. In the present invention, the signaling means 1 are preferably attached on the vest outer surface 2 so as to result in maximum visibility to other motorists. This invention contemplates that signaling means 1 may also be readily removed and replaced with alternate signaling means 1, for instance with a different color light source or with new replacement signaling means 1. The present technology with phosphorous-coated wiring is such that luminescence fades over time and may require replacement. Preferably, the signaling means 1 is held to the vest by means of a transparent material, for instance clear plastic or transparent fabric, that permits threading of the signaling means 1 along the vest surface 2. It is also contemplated that the transparent material which holds the signaling means 1 to the vest surface 2 preferably benefits from a zipper that permits removal and replacement of the signaling means. Preferably, Velcro means may also replace a zipper function to allow signaling means 1 replacement. The signaling means 1 of the present invention preferably wrap around and are threaded near the vest surface to ensure maximum visibility to other motorists. It is also contemplated that multiple signaling means 1 may be used along the same vest. For instance, in the present invention, two separate signaling means 1 are used next to one another to further enhance visibility on each side of the vest as viewed from multiple angles.

Figure 4:
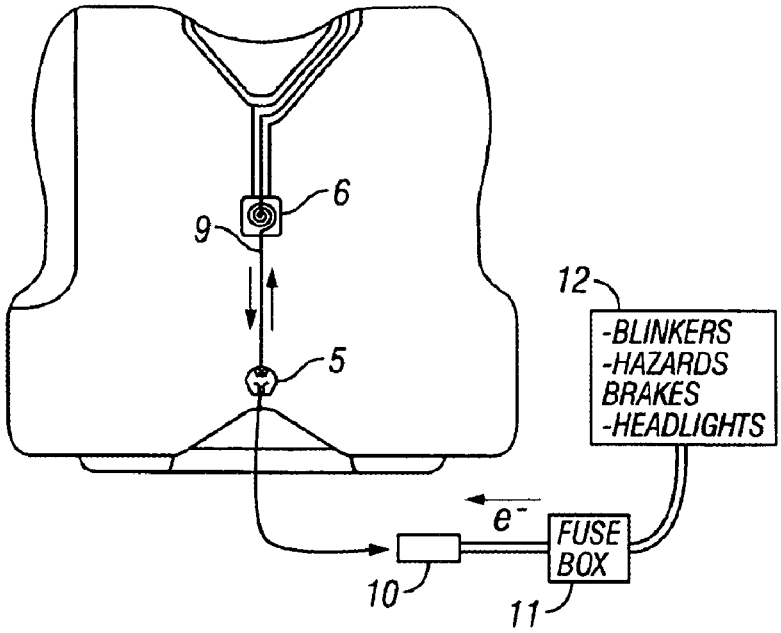
FIG. 4 is a front view of the vest depicting the vest port and the subsurface spring-coiled electrical wire attached to the port, which permits connection between the signaling means on the vest and the vehicle's power and signal apparatus through a vehicle port that leads to the vehicle fuse box.

The signaling means 1 are activated by and through electrical signals communicated from the power and signaling apparatus 12 of the rider's vehicle. The signaling means 1 are preferably connected to the vehicle's signaling and power source (signaling apparatus 12) through an electrical vest port 5 as depicted on FIG. 1. An electrical wire 9 runs from the vest port 5 to the signaling means 1. Typically, this electrical wire 9 is nonvisible from the vest outer surface 2 and is concealed subsurface for purposes of style and protection from the elements. The electrical wire 9 runs to the signaling means 1, and may run to multiple connecting points along the signaling means 1 to ensure even distribution of electrical power. FIG. 4 more completely shows this concealed electrical wire 9 which is typically housed through a spring coiled mechanism 6 that allows the vest port 5 and electrical wire 9 to be withdrawn into the vest when not in use and not connected to the rider's vehicle. The electrical wire 9 is preferably also weatherproofed by virtue of coatings of plastic or rubber material that are waterproof. The electrical wire 9 and vest port 5 are designed to extend from the vest and to connect to a vehicle adapter 10 that conveys electrical signals from the vehicle's fuse box 11, which is in turn fed by electrical signals from the vehicle's signaling apparatus 12, for instance, blinkers, hazard indicators, brakes or headlights. The originating electrical source is the vehicle battery and alternate sources that power the vehicle.

Figure 7:
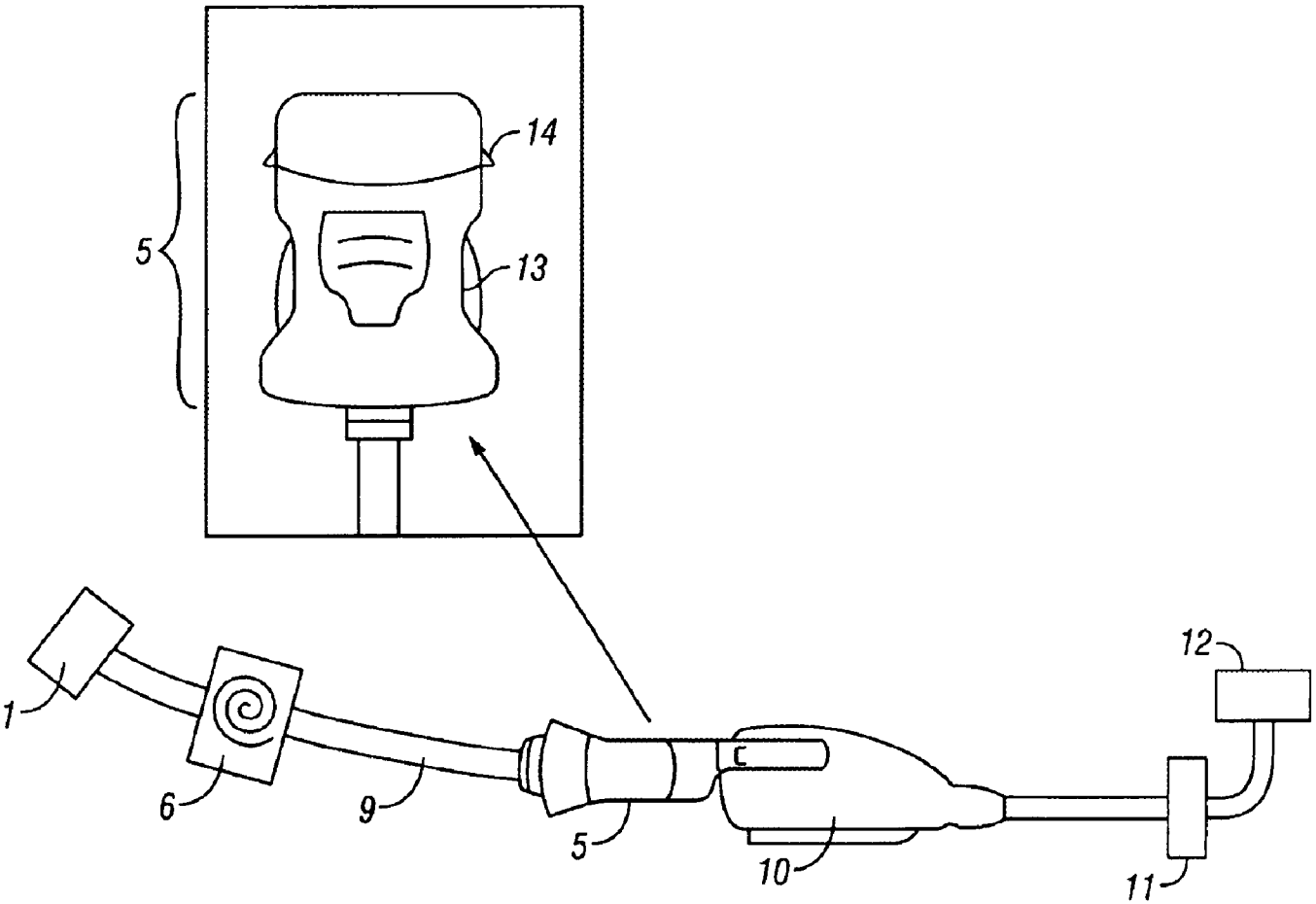
FIG. 7 depicts an embodiment of the present invention where the vest port is male, the vehicle adapter is female and the two ports are coupled physically and electrically preferably in releasable locking fashion. The figure also depicts the chain of electrical connection between the vehicle signaling apparatus and the luminescent signaling means of the rider's vest.

FIG. 7 is a detailed depiction of one preferable coupling of the vehicle adapter 10 and vest port 5. This figure shows how the vest port 5 is preferably "male" and designed to insert into the vehicle adapter 10 and become locked into place to maintain physical and electrical connection. As shown in FIG. 7, the locking means is preferably releasable by the operator by depressing release buttons 13 which cause the locking catch 14 to engage or release from the vehicle adapter 10. Preferably, this connection between the vehicle adapter 10 and vest port 5 enjoys a "break away" feature that is activated by force that would throw a rider from the vehicle upon unintentional dismount. The female vehicle adapter 10 would typically be fixedly connected to a lower portion of a motorcycle gas tank, for instance by the seat, where it would be conveniently accessed by a vest-wearing rider and the male vest port 5, which unwinds from the vest, and specifically the spring coiled mechanism 6. The vehicle adapter 10 is preferably connected by adhesive means to a convenient location accessible to the vest-wearing rider.

Figure 5:
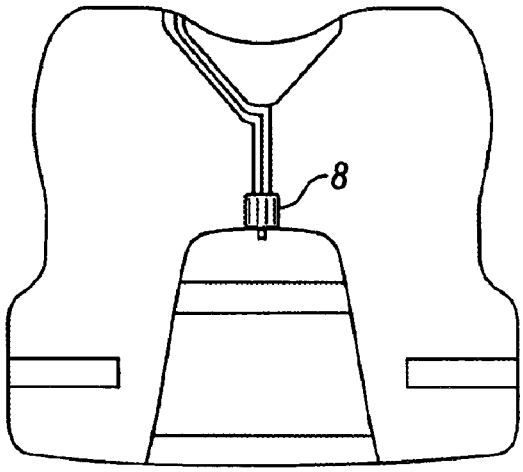
FIG. 5 is a rear view of the vest that depicts the subsurface electrical connection on the vest and further depicts a vest mater that may be used to connect to a separate vest of a separate rider.

FIG. 5 depicts an additional preferable feature of the invention, namely, a vest mater 8 that permits a second rider, with a similar safety vest to "plug in" to the first rider's vest and benefit from the safety and signaling features described herein. The vest port 5 of any vest is preferably adapted to connect to the vest mater 8 of another rider's vest. A releasable locking means as shown in FIG. 7 would preferably make such connection between vest port 5 and vest mater 8. Preferably, accidental dismount force of a rider(s) would also trigger a break away functionality between the vest port 5 and vest mater 8.

Figure 6:
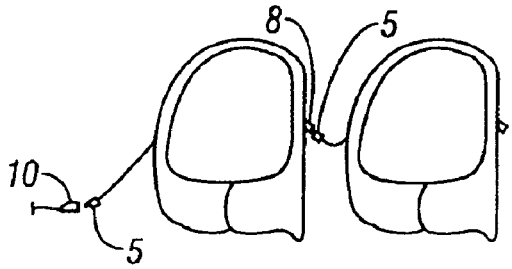
FIG. 6 depicts two vests, as they are adapted to connect first to the signal and power source of the vehicle and second to one another by way of a vest mater.

FIG. 6 also depicts how two separate vests may be coupled together and "feed" from the same power and signaling source, thus producing harmonious visual signals of vehicle operator intentions.

The vest is a safety benefit to the rider and other motorists because of the manner in which it enhances rider visibility to other motorists. In essence, the invention more completely merges the rider with the vehicle and extends the vehicle's existing safety features. For instance, when the rider desires to turn left or move into the left lane, activation of the vehicle's left blinker will simultaneously send an electrical impulse from the vehicle's signaling apparatus 12 through the vehicle's fuse box 11, which will in turn be conveyed to the vehicle adapter 10, through the coupled vehicle port 5, through the electrical wire 9 and then through the left most signaling means 1 on the vest. The signaling means 1 on the left side of the vest (including the front and back) will blink, indicating to other motorists the rider's intentions. The vest operates by exactly the same mechanism for right turns, except of course activating the right most side of the vest (including the front and back). Operation of the vehicle hazard indicators will cause both sides of the vest to blink with the vehicle's hazard lights. Similarly, using the brakes will cause the signaling means 1 to light up in the same fashion as brake lights on an automobile. It is further contemplated as a preference in this invention that the signaling means 1 of this invention will always emit light when in use and plugged in to the vehicle. However, in the event of braking, left or right signaling, or hazards, the intensity of the light will preferably increase and indicate the rider's specific action or intent. In this manner, the operative vest always enhances visibility, even when the rider is not engaged in a specific maneuver such as braking, left or right signaling, or using the hazards. This invention also contemplates that law enforcement officers may benefit from a use of this invention, which could also transmit specifically designed visual signals to correspond with use of a siren and lights. In this manner, the safety and visibility of motorcycle law enforcement officers could be better protected as they perform their duties in traffic.

While it is contemplated that the vest and the vehicle's signaling apparatus will communicate by and through electrical wires that connect the vehicle to the vest, it is also preferable and contemplated that the signals conveyed through the vehicle's signaling apparatus (turn signals, hazards, brakes) may also be conveyed from either the vehicle's fuse box 11 or the independent signaling apparatus (turn signals, hazards, brakes) directly to the vest by way of commonly understood radio means, i.e., signals which are amplified, transmitted and received by the vest, which communicates corresponding signals to other motorists through the visual signaling means 1 described herein.

Figure 3:
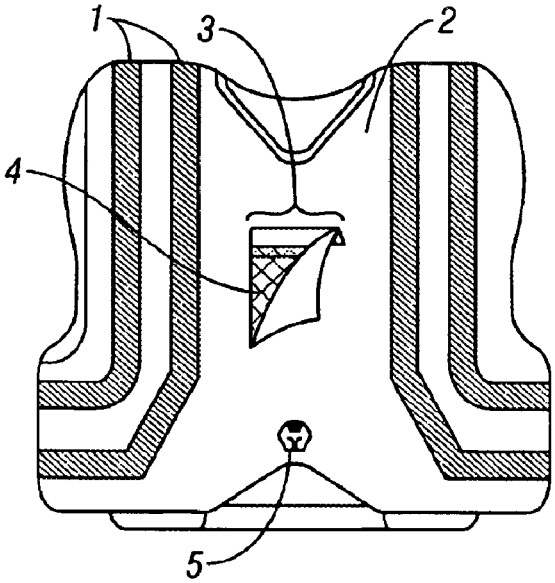
FIG. 3 is a side view of the vest depicted in FIGS. 1 and 2, further showing the vest's adjustable action feature, which allows fits for various rider shapes and sizes.

Other notable preferable features of the present invention include a device pouch 3, with an enclosed liner 4, preferably made of net or other expandable cloth or cloth material, that will be useful for holding personal use devices such as MP3 players, radios, cell phones, wallets, etc. A corresponding hole in immediate proximity of the device pouch will permit a wire from any such devices to extend up and through the vest to the rider's ear, mouth or other suitable orifice. Another preferable feature of the present invention is adjustable actions 7 as shown in FIG. 3, which allow the user of the vest to expand or contract the vest with personal needs. The device is designed using this feature to fit around and adjust to all body types and sizes, and also adapted to fit over clothing, even heavy jackets. The vest may expand preferably by way of adjustable buckles, adjustable Velcro devices or adjustable snap actions.

It is to be noted, however, that the appended drawings illustrate only typical embodiments of this invention and are therefore not to be considered limiting of its scope, for the invention may admit to other equally effective embodiments.

I claim:

1. A safety vest comprising:

(a) Electroluminescent signaling means threadably affixed to a vest surface adapted to be worn by a rider;

(b) said electroluminescent signaling means electrically connected to a vehicle's signaling apparatus; and (c) wherein activation of the vehicle's signaling apparatus by a rider causes said electroluminescent signaling means to illuminate and visually communicate the rider's actions.

2. The safety vest of claim 1 wherein the electroluminescent signaling means receives and illuminates consistent with electrical signals communicated from a fuse box on the rider's vehicle as the fuse box receives electrical signals from activation of vehicle signaling apparatus.

3. The safety vest of claim 1 wherein said signaling means receives electrical signals of rider action transmitted initially from the vehicle signal apparatus, to a fuse box, which electrical signals are sent through said fuse box to a vehicle adapter, where said vehicle adapter electrically and physically couples with and transmits the electrical signals to a vest port, then through an electrical wire to said signaling means.

4. The safety vest of claim 1, wherein the signaling means is made of an electroluminescent phosphorous-coated copper wire, so that receipt of an electric current by the electroluminescent phosphorous-coated copper wire causes the wire to illuminate.

5. The safety vest of claim 1, further comprising a device pouch on the vest front adapted to receive personal use devices, whereby MP3 players, radios, wallets and phones may be stored by the user.

6. The safety vest of claim 1, further comprising adjustable actions, wherein the vest may be worn over jackets, heavy or light clothing, and by persons of varying sizes.

7. The safety vest of claim 1 wherein the electrical communication of rider intentions from vehicle signal apparatus to the signaling means of the vest is by way of radio device.

8. The safety vest of claim 1 wherein an electrical wire connecting a vest port and signaling means is mounted to a spring coil, which is retractable into said vest.

9. The safety vest of claim 1 wherein the signaling means is replaceable, to accommodate expired luminescence or desire for color change.

10. The safety vest of claim 1 wherein a vest mater on a first rider's vest permits a second rider wearing a separate second safety vest to electrically and physically couple to a first rider's vest through a vest port of the second safety vest, wherein the signaling means of the second safety vest is electronically harmonized to respond in exactly the same manner as the first rider's vest to electrical signals from the riders' shared vehicle.

11. A method of operating the a safety vest comprising the following steps:

(a) Sending an electrical signal from a vehicle signal apparatus to a vehicle fuse box, which communicates rider action;

(b) Sending the electrical signal from said fuse box to a vehicle adapter;

(c) Sending the electrical signal from said vehicle adapter to a vest port;

(d) Sending the electrical signal from said vest port through an electrical wire to an electroluminescent signaling means, said electroluminescent signaling means illuminating consistent with the electrical signal of said vehicle signal apparatus.

* * * * *